US011180825B2

(12) United States Patent
Laín Rodríguez

(10) Patent No.: US 11,180,825 B2
(45) Date of Patent: Nov. 23, 2021

(54) PROCESS FOR THE DEPRESSION OF IRON SULPHIDES AND OTHER DISPOSABLE ELEMENTS IN THE CONCENTRATION OF MINERAL BY FLOTATION AND ELECTROCHEMICAL REACTOR

(71) Applicant: LAIN TECHNOLOGIES LTD, London (GB)

(72) Inventor: Eva Maria Laín Rodríguez, Pozuelo de Alarcon (ES)

(73) Assignee: LAIN TECHNOLOGIES LTD, London (GB)

( * ) Notice: Subject to any disclaimer, the term of this patent is extended or adjusted under 35 U.S.C. 154(b) by 111 days.

(21) Appl. No.: 16/323,029

(22) PCT Filed: Aug. 2, 2017

(86) PCT No.: PCT/ES2017/070563

§ 371 (c)(1),
(2) Date: Feb. 4, 2019

(87) PCT Pub. No.: WO2018/024934

PCT Pub. Date: Feb. 8, 2018

(65) Prior Publication Data

US 2019/0169709 A1 Jun. 6, 2019

(30) Foreign Application Priority Data

Aug. 3, 2016 (EP) ..... 16382382
Mar. 28, 2017 (ES) ..... ES201730450

(51) Int. Cl.
*C22B 1/11* (2006.01)
*B03D 1/14* (2006.01)
(Continued)

(52) U.S. Cl.
CPC ..... *C22B 1/11* (2013.01); *B03D 1/02* (2013.01); *B03D 1/06* (2013.01); *B03D 1/085* (2013.01);
(Continued)

(58) Field of Classification Search
CPC ..... B03D 1/02; B03D 1/021; B03D 1/023; B03D 1/025; B03D 1/026; B03D 1/028; B03D 1/04; B03D 1/06; C02F 1/465
See application file for complete search history.

(56) References Cited

U.S. PATENT DOCUMENTS 1,891,776 A 12/1932 O'Malley
2,258,507 A * 10/1941 Hammond ..... B03D 1/028 209/166
(Continued)

FOREIGN PATENT DOCUMENTS

WO 2016/027158 A1 2/2016

OTHER PUBLICATIONS

S.Chander, "Electrochemistry of sulfide mineral flotation", Minerals and Metallurgical processing, Aug. 1, 1988, pp. 104-114, vol. 5, No. 3.
(Continued)

*Primary Examiner* — Salil Jain
(74) *Attorney, Agent, or Firm* — Sughrue Mion, PLLC

(57) ABSTRACT

A process for the depression of iron sulphides and other disposable elements in the mineral concentration by flotation and electrochemical reactor. The proposed invention represents a method based on the action of electrodes on the mineral, which can replace, compliment or minimise the consumption of chemical reagents, as well as improving the effect thereof.

16 Claims, 5 Drawing Sheets

(51) Int. Cl.

| | |
|---|---|
| ***B03D 1/08*** | (2006.01) |
| ***B03D 1/02*** | (2006.01) |
| ***B03D 1/06*** | (2006.01) |
| ***C22B 3/22*** | (2006.01) |
| ***C25C 1/12*** | (2006.01) |
| ***C25C 1/16*** | (2006.01) |
| ***C25C 1/18*** | (2006.01) |

(52) U.S. Cl.
CPC ..... *B03D 1/1437* (2013.01); *C22B 3/22* (2013.01); *C25C 1/12* (2013.01); *C25C 1/16* (2013.01); *C25C 1/18* (2013.01); *B03D 2201/06* (2013.01); *B03D 2203/02* (2013.01)

(56) References Cited

U.S. PATENT DOCUMENTS

| | | | | |
|---|---|---|---|---|
| 3,932,271 | A | 1/1976 | Nagano et al. | |
| 3,933,625 | A * | 1/1976 | Nagano | B03B 1/00 209/9 |
| 6,210,648 | B1 * | 4/2001 | Gathje | B03D 1/02 423/26 |

OTHER PUBLICATIONS

A. Lopez Valdivieso et al., "Flotation and depression control of arsenopyrite through pH and pulp redox potential using xanthate as the collector", International Journal of Mineral Processing, Oct. 1, 2006, pp. 27-34, vol. 81, No. 1.
International Search Report for PCT/ES2017/070563 dated Mar. 13, 2018 [PCT/ISA/210].
Written Opinion for PCT/ES2017/070563 dated Mar. 13, 2018 [PCT/ISA/237].

* cited by examiner

PROCESS FOR THE DEPRESSION OF IRON SULPHIDES AND OTHER DISPOSABLE ELEMENTS IN THE CONCENTRATION OF MINERAL BY FLOTATION AND ELECTROCHEMICAL REACTOR

CROSS REFERENCE TO RELATED APPLICATIONS

This application is a National Stage of International Application No. PCT/ES2017/070563 filed Aug. 2, 2017, claiming priority based on European Patent Application No. 16382382.6 filed Aug. 3, 2016 and Spanish Patent Application No. P201730450 filed Mar. 28, 2017.

OBJECT OF THE INVENTION

The present invention relates to a process for the depression of iron sulphides and other disposable elements, mainly although not exclusively pyrite, in the concentration of mineral by flotation. Likewise, it relates to an electrochemical reactor.

Said process, as well as the reactor, replace, minimise, optimise or compliment the use of depressants and other chemical reagents during the depression of iron sulphides and other disposable elements such as arsenic, antimony, bismuth, mercury and lead. This invention is particularly relevant to the flotation of sulphide minerals of all types.

The field of the invention mainly applies to nickel, copper, zinc and lead ores.

BACKGROUND OF THE INVENTION

Flotation is used to concentrate or separate mineral species through the selective adhesion of mineral particles of each species to air bubbles. These bubbles float up to the surface of the liquid, forming foam that is collected as the product of said process. The adhesion of the particles to the bubbles happens mainly as a function of the hydrophobicity of the mineral surface. The most hydrophobic particles tend to adhere to the bubbles, thereby floating, while the more hydrophilic ones tend to get surrounded by liquid, thereby being depressed. To modulate the hydrophobicity and consequent flotation of the different mineral species, typically, chemical reagents are added, such as collectors, depressors, activators, inhibitors, foaming agents or modifiers [11].

In the flotation of sulphides, for example nickel, copper, zinc and lead ores, a main objective of concentrating the mineral/s of interest consists of the selective depression of pyrite (sulphur and iron mineral), as trading iron is rarely profitable. In addition, pyrite and other sulphides can be associated with or contain elements that are of no interest or that are harmful, which can be penalised at a commercial level, such as arsenic, antimony, bismuth, mercury and lead. Therefore, upon eliminating/reducing said elements from the concentrate, the penalties for said elements can be reduced. Usually, the depression of pyrite and other sulphides to be discarded is achieved by modifying the pH by means of the addition of chemical depressants, typically cyanide or sodium metabisulphite [10].

Several ways of depressing pyrite have been devised. The main methods are as follows:

- Raising the pH of the solution, for example through the addition of lime [1].
- Addition of cyanide salts, such as potassium cyanide, sodium cyanide and potassium ferricyanide [2].

- Addition of sulphur-based and oxygen-based compounds, such as sulphite, bisulphite, metabisulphite and sulphur dioxide [3], [4], [5], [6], [7]
- Addition of iron salts, such as iron sulphate or ferrous sulphate [2]
- Addition of hypochlorite salts, such as sodium hypochlorite or calcium hypochlorite [8]
- The use of organic reagents, such as starch, pyrogallic acid and tannic acid [8].

Even though these are used at an industrial level in the plants for concentration of minerals by flotation, the conventional methods for the depression of pyrite and other sulphides through the addition of chemical depressants have several disadvantages. Firstly, these entail relatively high costs of consumables, as well as of the water treatment process in order to clean and adapt it for reutilisation in the flotation circuits. Moreover, the use of certain depressants such as cyanide is increasingly restricted, due to its toxicity and associated environmental risk [9].

The process object of the present invention entails a great advantage compared to the conventional methods, given that it makes it possible to save on chemical reagents, which currently represent a significant cost. Specifically, the proposed process and reactor represent an electrochemical method for the depression of pyrite and other disposable sulphides, which does not necessarily employ chemical depressants.

The choice of electric potential enables any potential value to be use, unlike with chemical reagents, which are limited to discrete potential values. In addition, it enables the pH and the electrochemical potential to be independently varied, not just at a macro level but also at a local level. Consequently, this process enables a higher specificity in the depression action, increasing the resolution in the differential flotation between the minerals of interest and the unwanted sulphides. Therefore, it enables the grade-recovery relationship of the metals of interest to be optimised, offering greater benefits starting from the same input ore. Furthermore, not only is the treatment of the minerals introduced into the plant optimised; but the improvement in the quality of the concentrate can entail the reclassification of certain minerals, previously considered sterile due to not making the quality cut, resulting in the in-plant treatment of minerals that would otherwise be discarded. On the one hand, this could entail important savings, as less mineral would be moved to generate the same product; on the other hand, this could simplify the logistics of the mine, due to the fact it is no longer necessary to avoid or blast and discard certain areas that are currently considered sterile. Likewise, the blending of better and worse concentrates in order to obtain certain quality levels could be prevented or minimised.

Another advantage is the speed in changing the electric potential, which enables a fast response (virtually instantaneous) by the flotation process control system, which is relatively slow (typically minutes or hours) in the current system, as it depends on the concentration and flow of chemical reagents, which can remain recirculating in the system during relatively long periods of time.

Likewise, this process allows for a greater versatility in the flotation circuits, given that the process water is not chemically conditioned as it currently is, it being possible to vary the flotation conditions with greater ease in a modular manner, within the same circuit, line or treatment plant.

DESCRIPTION OF THE INVENTION

The present invention concerns a process according to claim 1, and an electrochemical reactor, according to claim 13, for the depression of iron sulphides and other disposable elements, mainly although not exclusively pyrite, in the concentration of mineral by flotation, which replaces, minimises, optimises or compliments the use of depressants and other chemical reagents. This invention is particularly relevant for the flotation of sulphide minerals of all types.

The process is based on the application of electric potential by at least one electrode, in order to simulate the electrochemical effect that the chemical depressants and other reagents have on the mineral particles. Therefore, through direct contact between the electrode and mineral particles, altering the surface of the mineral that are to be depressed is attained, such that it's hydrophilic character is increased, thus preventing the adhesion thereof to the bubbles, resulting in the depression thereof. This is an electrochemical alteration of the surface of the mineral particles, for which reason it translates into an improved selectivity in the separation by flotation. It does not, however, refer to electrostatically attracting towards the electrode(s) or repulsing from the electrodes the mineral particles (or mineral-bubble complexes).

As mentioned, the process consists of the application of potential, by means of a working electrode, in situ or ex situ, directly or indirectly, on the mineral particles in the pulp. Said application requires either direct contact between the electrode and the mineral, which is more likely to happen if the particles are in movement, for example by stirring, or by the transference of potential by means of electrochemical mediators.

In the process, which is typically electrolytic, although it can also be galvanic, the working electrode is polarised to certain potential values. These values are chosen in order to condition the surface of the pyrite species or other sulphides to be discarded, with the aim of increasing the hydrophilic character of said surface. Typically, the intention is to catalyse the selective formation of hydroxides on the surface of the pyrite. For which reason, the potential of choice is usually positive; the working electrode acts as an anode. Furthermore, said potential would typically lie below the potential of electrolysis of water, so that bubbles are not generated on the surface of the electrode and the pH does not change. It is worth mentioning that the application of potential is a pH-independent variable, at least at the macro level (although it would be possible to modify the pH at a macro level, any changes in pH would typically occur at a local level), which enables a higher resolution in the differential flotation of the minerals in question. The altering of the pH at the local level can be carried out by using the potential(s) necessary for generating or consuming hydroxyl protons/ions, e.g. acidification of the medium as a consequence of water hydrolysis, upon generating protons. Said pH alteration occurs in the local surroundings of the electrode, without affecting the pH of the general medium, when the influence of the electrochemical reactions carried out by the electrode is limited, in relation to those determining parameters, such as relatively high volumes and flows and/or relatively short residence times, which mask the pH changes generated by the electrode(s). It is most normal for the pH to be altered at the local level. However, altering the pH would be possible at a macro/general level, upon the electrochemical reactions carried out by the electrodes having an important influence on the pH of the medium, in relation to determining parameters, such as relatively low volumes and flows and/or relatively long residence times, which allow for extending, at the macro level, the changes in pH originally generated at the local level in the surface of the electrode(s).

The process is based on the use of an electrochemical cell in the mineral pulp circuit, at any point thereof, be it in the flotation cells or in conditioning or passing tanks or pipes upstream of, downstream of or intercalated in the process, whether pre-existing or added.

The electrochemical reactor may take any form, from a simple reactor with two parallel, flat electrodes, to more complex apparatus, such as column, packed bed and/or multi-tubular reactors, and/or that constitute or take advantage of at least part of the elements of the mineral treatment line, such as, for example, the flotation cells, containers or passages of pulp and mills, including any structure or element in the plant or line/circuit of treatment, the electrodes (at least partially) being submerged in liquid/pulp (at least while they are in operation). For example, the following may be coated and/or used as electrode/s: deflectors, pipes, passages, conditioning tanks, thickeners/cyclones, air or mineral dispersers, stirrers, false floors, sieves/filters, linings or elements of the mills such as the balls and rods.

The electrodes may be made of any conductor or semiconductor material, and they can be treated, for example, in order to modify the affinity with the pulp and/or mineral species and/or liquid(s), for example, through (pre)treatment/s to increase the hydrophobicity or hydrophilicity of the surface, as well as modified/treated/impregnated/associated/doped with catalysts or modifiers of potential, activation energy or other energetic or thermodynamic considerations. Likewise, the electrodes may be magnets or be magnetised, optionally to preferably attract or repel certain mineral species. Typically, electrodes made of stainless steel 316L would be used (alloy of iron, nickel, chrome, molybdenum and carbon), in order to prevent the rusting of the electrode given the medium and the potentials used.

Said electrodes may take any form, from flat sheets (smooth, perforated or articulated), to the shape of existing structures from the line/s of treatment (or lining of these). In addition, the surface can be maximised or modulated by the use of electrodes with three-dimensional surfaces, perforated surfaces or surfaces of particular roughness. The electrodes may be assisted by systems, in situ or ex situ, for their cleaning and/or maximising/modifying of the current efficiency, for example mechanical systems to maintain the surface clean, prevent/correct/minimise/act on impurities or aggregates, such as for example brushes or vibration/ultrasound systems for the release of particles/adhered species, and/or systems to prevent/correct/mitigate/act on physicochemical inconveniencies, such as for example programs to vary the potential/s against passivation layers formed on or from the electrode/s or chemical treatment systems. The electrochemical reactor may be assisted by washing systems such as hoses/vehicle washers/other water cleaning systems, which operate manually/semi-automatically/automatically, optionally in conjunction with systems to move said cleaning elements or reactor elements, such as hoists, or to empty/fill the tank housed by the reactor. The electrochemical reactor as well as the elements that house it may have security systems to prevent, mitigate or act in the event of electric discharge or short circuit, such as separators, rubber coatings, insulating coatings, ground wires, fuses and smart systems to guarantee safety. Likewise, the reactor may have mechanical supports suitable for the correct anchoring of the components thereof.

The process has two main modalities. In the first one, the potential is conferred to the mineral directly by the electrode. This requires direct contact between the mineral and the electrode. In the second modality, the potential is conferred to the mineral by means of chemical/electrochemical mediators, typically dissolved in the medium, added or already present in the medium (for example thiosalts), although they can also be conductor or semiconductor solids, again being added or already present (for example mineral particles), or a combination of these. Likewise, the process allows for the combination of the two modalities, both simultaneously, sequentially, in series and/or in parallel, using the same reactor or different reactors.

In the case of requiring direct contact between the electrode and the mineral, the electrochemical reactor may be assisted by additional mechanisms in order to promote/maximise/force said contact. These mechanisms may for example be stirrers and/or pumping and/or mixing and/or aeration and/or bubbling and/or vibration systems to promote/maximise the contact, and/or press filters and/or other types of presses and/or filters to force said contact or physicochemical methods to modulate the affinity between the electrode and the mineral, for example the modulation of hydrophobicity or the magnetising of the electrode, optionally to selectively foster the affinity (or lack thereof) with certain mineral species.

By means of the process object of this invention, several objectives may be attained:

The first objective of the process is the depression of iron species, mainly pyrite, to increase the grade of the metal of interest in the concentrate. To that end, potentials are applied on the mineral, in a direct and/or indirect manner, which cause the surface of the species that are to be depressed to become more hydrophilic, preferably in a selective way, preventing or minimising said effect on the minerals of interest to be floated. This effect can be performed both in the presence or absence of reagents and/or pH modifiers, acting independently or in collaboration with said agents. For example, one way of selectively depressing pyrite is to catalyse the formation of hydroxides on its surface, which renders it more hydrophilic. In addition, potentials to positively or negatively charge certain mineral species can be applied; depending on the charge of the collector/s and/or reagent/s, this will lead to their flotation or depression. This greater selectivity between the fractions to be floated and depressed is translated into an increase of the grade of the metal of interest in the floated concentrate. In other words, upon depressing more iron species, a higher percentage of the metal of interest in the floated fraction is achieved.

The second objective of the process is the depression of species that contain or are associated with unwanted elements, mainly penalising elements such as arsenic, antimony, bismuth and mercury, as well as elements discarded due to economic or logistic considerations (for example differential flotation) such as zinc and lead. To that end, as for the depression of iron species, potentials are applied on the mineral, in a direct and/or indirect manner, which cause the surface of the species that are to be depressed to become more hydrophilic, preferably in a selective manner, preventing or minimising said effect on the minerals of interest to be floated. Again, this effect can be performed both in the presence and absence of reagents and/or pH modifiers, acting independently or in collaboration with said agents.

The third objective of said process is the purge of metals in solution or other substances that are to be cleaned, through their deposition/precipitation, optionally selective (for example by means of the choice of separator and/or potential/s), preferably inside a compartment in the relevant configurations, preferably by means of electrodeposition over/constituting the cathode. For example, the purge of copper in solution through the electrodeposition thereof on the cathode allows for minimising the activation of sphalerite, enabling at the same time the recovery of copper in a useful way. Said cleaning is not restricted to the elimination of these substances from the solution, but also includes their transformation to other forms that do not imply or that minimise problems derived therefrom, and/or that cheapen their management (for example, the oxidation of thiosalts).

The fourth objective of the process is to promote the recovery of metals or substances of interest, by fostering floatability, for example by means of positively charging the minerals, optionally by allowing less alkaline ranges of pH to obtain the same grade of the metal of interest in the final concentrate, optionally in the presence of reagents such as for example negatively charged collectors.

The fifth objective is the saving/optimising of certain reagents, either by eliminating the addition thereof, minimising it or maximising the effectiveness thereof, such as for example lime and/or certain collectors, depressors, modifiers or chemical reagents/additives. Said optimisation may take place in the entirety or in any part of the process, for example, minimising the lime and/or the depressors in the rougher flotation but maintaining, nonetheless, the conventional levels of said reagents downstream of the regrinding/in the cleaner flotation. An additional advantage of this is the higher recovery of the metals and/or substances of interest, for example by achieving a higher recovery at least in the rougher concentrate as a consequence of carrying it out at a less alkaline pH, which, as made possible by this process, would not impair the grade of the metal of interest in the concentrate. This fifth objective consists of improving the resolution in the separation of mineral species, by adding one more dimension (potential) to the differential flotation, which is possible since pH and potential are independent variables since in this process we are typically below the potential of water hydrolysis, and if the pH changes, it can be guaranteed that this occurs exclusively at a local level, and not at a general/macro level. This is not possible in conventional flotation, as the potential tends to be linearly dependent on pH. Hence, in order to lower the potential, the pH must necessarily be alkalinised and vice versa, which tends to be negative at the recovery level (if the solution is alkalinised), or at the grade level of the metal or substance of interest in the final concentrate/s (if the solution is acidified). This leaves a window open for the improvement of the grade and recovery as a whole, which is achieved by means of the use of this process.

Finally, the ideal industrial configuration would be the implementation of the process both in a passage (for example a pipe or expansion/compartment that houses the reactor in question, optionally by means of perforated or ring-shaped electrodes or of favourable configurations at the hydrodynamic level) or a conditioning tank prior to the rougher flotation, or in a passage like the one previously described or in a conditioning tank prior to any stage of the cleaner flotation and/or scavenger flotation. The reactor may be configured as a combination and/or matrix of the morphological unit(s).

The reactor may be installed parallel to the walls of the tank or compartment containing the pulp or through which the pulp passes, and/or constituting/taking advantage of at least part of these, and/or arranged in any way, for example in such a way as to maximise the electrode surface per volume of pulp, optionally using mosaics of reactors, column and/or bed configurations (e.g. packed, percolating, slurry phase and/or bubbling), (multi) tubular configurations, sieving, and/or to promote/modulate the hydrodynamics in the tanks or passages, optionally taking advantage of or acting as deflector(s). The reactor may take any shape, from a simple configuration with two parallel, flat electrodes, to more complex apparatus, such as a reactor that constitutes and/or takes advantage of at least part of the structures and/or elements of the mineral treatment line(s), such as the flotation cells, tanks, containers or passages of pulp, including any element in the plant or treatment line/circuit, such as pipes, conditioning tanks, elements such as, for example, air dispersers, stirrers, false floors, deflectors, linings and/or structures, and/or elements of the mills such as the balls, the rods and/or structures.

Mechanical/physical, electrical and/or chemical parameters of the system may be controlled by smart control systems, optionally remotely, in order to monitor and adjust the reactor, optionally in relation to process data for example from a laboratory/Courier data/mechanical or physicochemical parameters. In addition, automated transport systems can be used for processes such as the distribution of mineral to the electrode, the recirculation of the pulp, liquid/medium and/or solids, and/or extraction/cleaning/replacement/movement/modification/regeneration of electrodes or other elements of the reactor. Furthermore, the reactor design could allow for changing the separator/s, electrodes and/or other constituting elements without the need for disassembly.

DESCRIPTION OF THE FIGURES

To complement this description and with the aim of aiding a better understanding of the characteristics of the invention, in accordance with an example of preferred embodiment, this description is accompanied, as an integral part thereof, by a set of figures where, by way of illustration and not limitation, the following is represented.

PREFERRED EMBODIMENTS OF THE INVENTION

The present invention relates to a process for the depression of iron sulphides and other disposable elements in the flotation of mineral particles in liquid, which would typically take place after the stages of extraction, crushing, grinding and suspension in liquid of the mineral.

Figure 9:
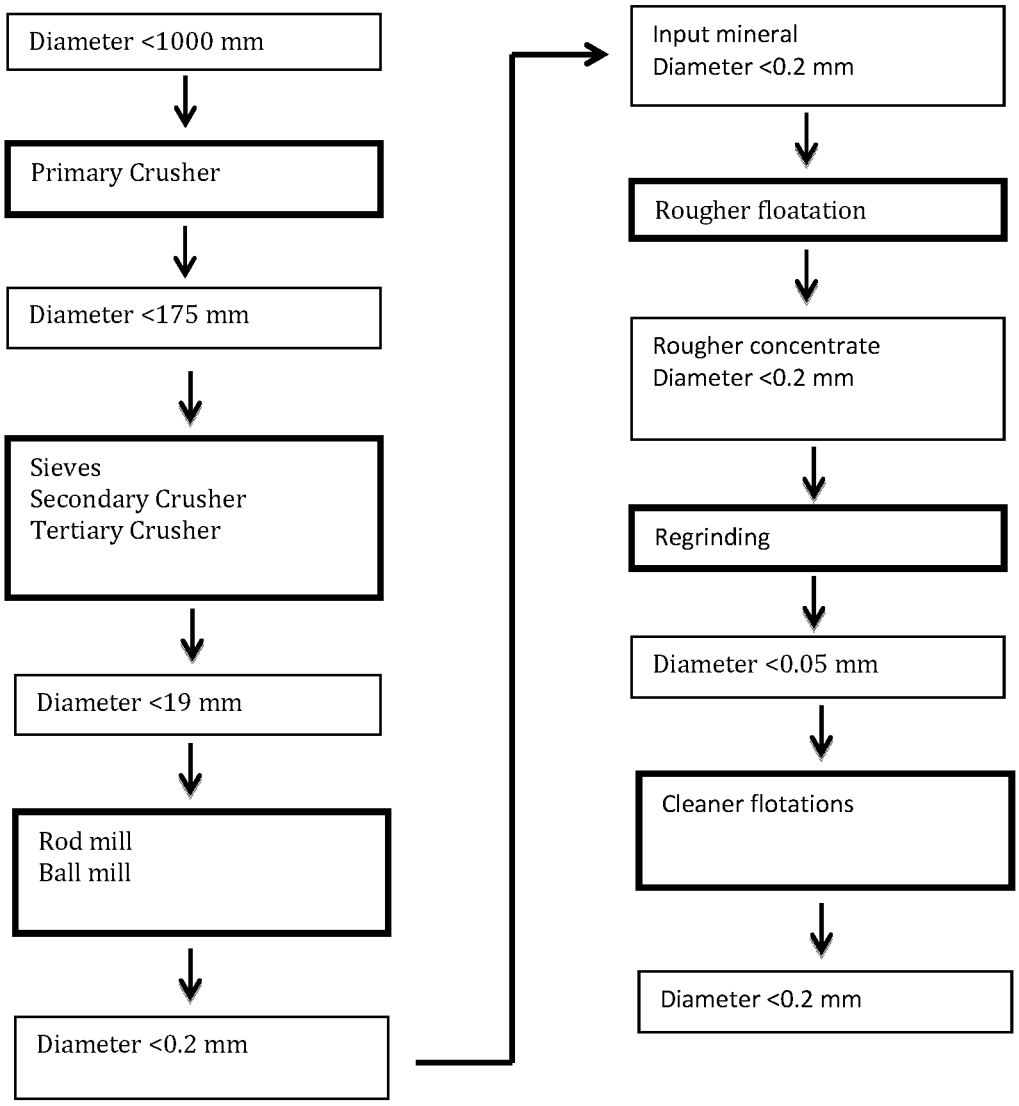
FIG. 9 shows a block diagram of the iron sulphide depression process.

An example of said processing for copper ores is presented below, illustrated in FIG. 9. Firstly, mineral that is rich in copper sulphides would be extracted from the mine by blasting. Subsequently, said mineral would be transported to the primary crusher by Dumper lorries, where the diameter of the mineral particles would be reduced from approximately less than 1000 mm down to less than 175 mm. The product of the primary crusher would be sieved such that those particles with a diameter larger than 65 mm would pass through the secondary crusher, yielding particles with a diameter less than 65 mm. Said particles would pass through the tertiary crusher, yielding in turn particles with a diameter less than 19 mm.

The next step would be a grinding stage, either in a rod mill or a ball mill, in order to produce particles with a diameter less than 0.2 mm. The next step would be the stirring of the mineral pulp in a conditioning tank prior to the rougher flotation, which would be an ideal moment for the application of electric potential. In this way, the particles could be conditioned before the first flotation. The product of the rougher flotation is the rougher concentrate, the main objective of which is to eliminate most of the gangue (mainly silicates), as well as part of the iron sulphides (specifically pyrite).

The product of the rougher flotation would be subjected to a regrinding stage, where the diameter of the particles would be reduced from less than 0.2 mm down to less than 0.05 mm. Subsequently, the mineral pulp is stirred in a conditioning tank, before the three cleaner flotations and the scavenger flotation. Again, said tank could be used for the application of electric potential, with the aim of conditioning the mineral before the cleaner flotations. Likewise, conditioning tanks or intermediate passages where electric potential would be applied could be introduced, for example between the first and second cleaner flotations, as well as between the second and third cleaner flotations. The product of the flotation process, after thickening and filtration stages, is the final concentrate, which would typically be composed of copper sulphides such as chalcopyrite and chalcocite, containing at least 20% copper.

The previously described process incorporates at least a reactor for the application of electric potential. Said reactor can have different configurations. Below, some of the possible reactor configurations are cited. In all of the reactor configurations, the mineral may or may not come into contact with the electrode, although the first option is the preferred one. As mentioned, the option of contact consists of the particles touching the electrode, which can be achieved by stirring or moving the pulp, thereby guaranteeing the contact, at least during an instant. In the configuration without contact or the indirect configuration, an electrochemical mediator is used, whether present or added, to transfer the electric potential from the electrode to the mineral particles. In this case, the direct contact between the mineral and the electrode is not necessary. In any case, if an electrochemical mediator is used, it will also be possible to use a reactor with direct contact, although in that case it would not be necessary to guarantee the contact from a hydrodynamic point of view. Other options would be to use an ex situ reactor or to coat the electrode of interest with a separator in order to prevent direct contact with the mineral. Typically, a relatively low potential, from 0 to 12 volts, difference is used between the anode and the cathode.

Figure 1:
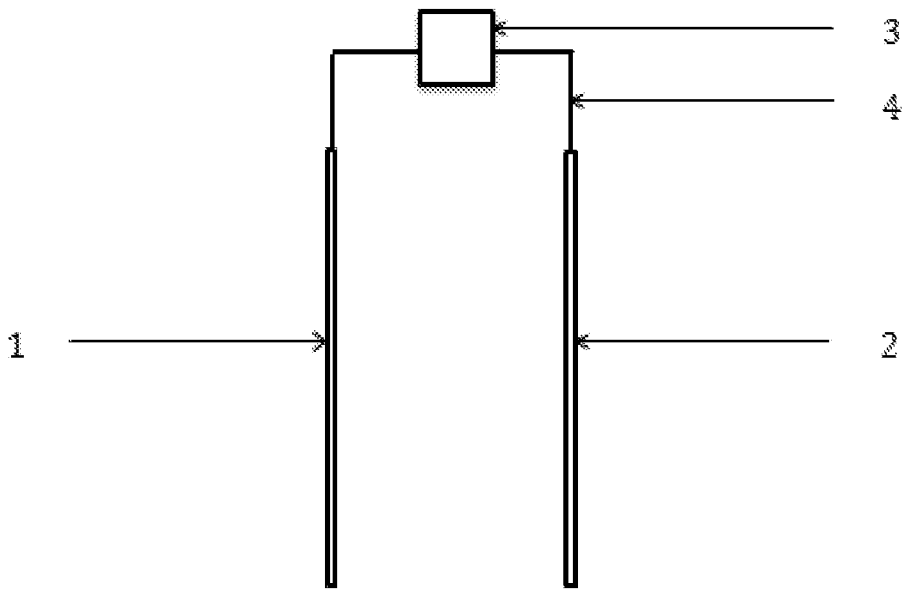
FIG. 1 shows a first example of a reactor formed by a simple electrochemical cell.

The first reactor configuration is a simple electrochemical cell. Said cell, illustrated in FIG. 1, consists of a counter electrode (1), a working electrode (2), a source of electricity (3) and at least one connection between these three elements (4). In this example, the anodic and/or cathodic and/or medium and/or cell potentials can be controlled with a potentiometer and/or potentiostat, and/or with any electric supply/circuit/electric component (battery, plug, rectifier, etc. that can be assisted by a potentiometer and/or potentiostat).

Figure 2:
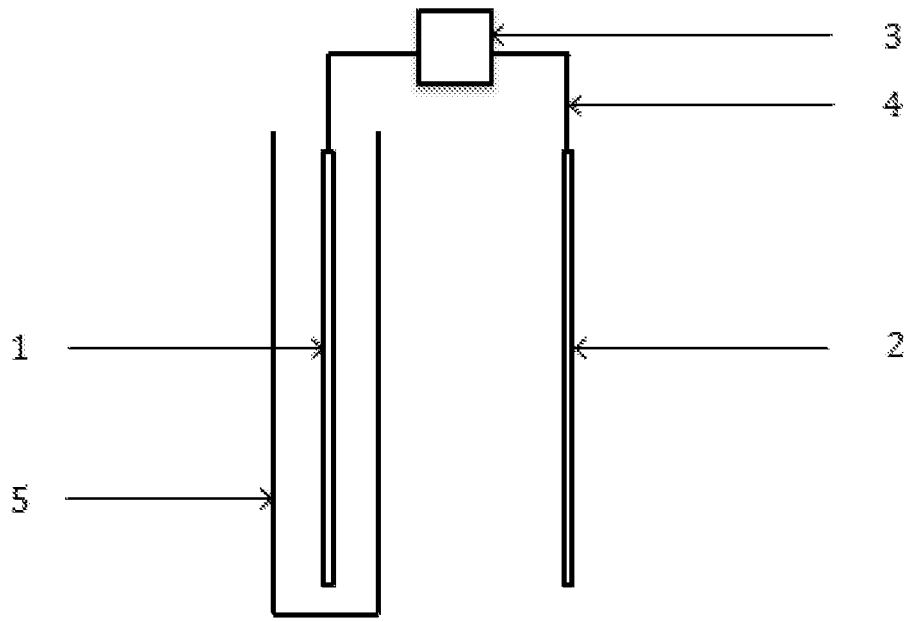
FIG. 2 shows a second example of a reactor also formed by a simple electrochemical cell.

The second reactor configuration is a simple electrochemical cell, where at least one of the electrodes is, partially or totally, isolated from the pulp medium and/or other electrode(s) and/or liquid by a separator/s. This arrangement, which prevents contact between the counter electrode and the mineral particles by means of a physical separator, is the most favourable process configuration. Said cell, illustrated in FIG. 2, consists of a counter electrode (1), a working electrode (2), a source of electricity (3) and one connection/s between these three elements (4), where the anode and/or cathodic and/or medium and/or cell potentials can be controlled with a potentiometer and/or potentiostat, and/or with any electric supply/circuit/electric component (battery, plug, rectifier, etc. that can be assisted by a potentiometer and/or potentiostat). In addition, it has the separator/s (5), which can be constituted by ion exchange membrane(s), for example anionic or cationic exchange membranes, both generic as well as with ions/elements/specific compounds, fluid membrane(s), organic phase(s), dialysis membrane(s), grate(s), sheet(s) or perforated structure(s), ionic bridge(s), filter(s), sponge(s), (porous) separator(s) for batteries or any type, or a combination of these. Said separators may be placed at a certain distance from the electrode(s), e.g. finite-gap configuration, or in direct contact with the electrode(s), e.g. zero-gap configuration, or as a combination of the same.

Figure 3:
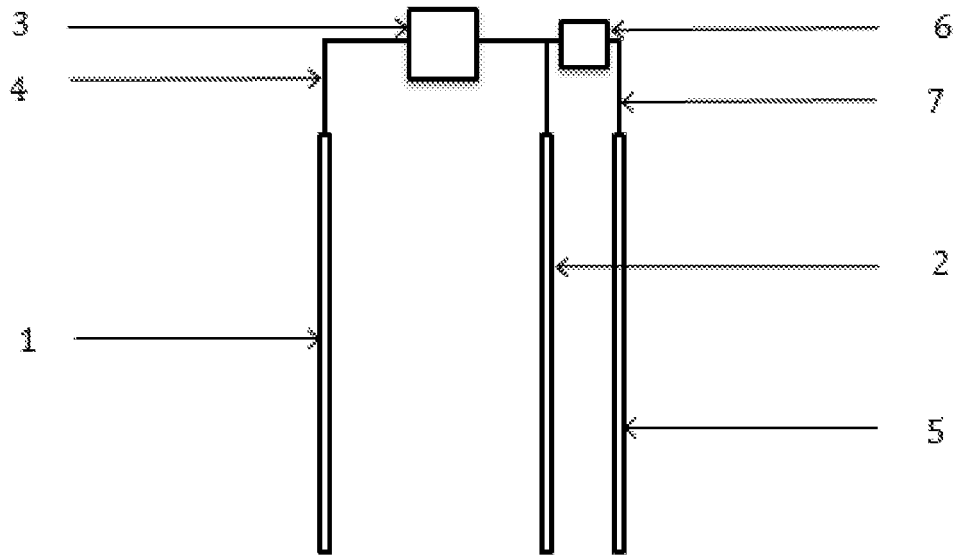
FIG. 3 shows a third example of a reactor that is a variation of the first example.

The third reactor configuration is a variation of the first configuration. Said cell, illustrated in FIG. 3, has the same elements as the first configuration (a counter electrode (1), a working electrode (2), a source of electricity (3) and a connection(s) between these three elements (4), where the anodic and/or cathodic and/or medium and/or cell potentials can be controlled with a potentiometer and/or potentiostat, and/or with any electric supply/circuit/electric component (battery, plug, rectifier, etc. that can be assisted by a potentiometer and/or potentiostat). In addition, it has a third electrode (5), optionally a reference electrode such as for example silver/silver chloride, connected to at least one of the electrodes via a connection(s) (7), and of an element (6) for measuring the potential difference between the working electrode and the third electrode and/or between the counter electrode and the third electrode. Said element (6) is preferably a voltmeter or a multimeter, and it can have/be connected to/collaborate with feedback/response/monitoring/adjustment systems related to the control system for the anodic and/or cathodic and/or medium and/or cell and/or partial ionic and/or pulp and/or zeta potential(s) or a combination of these.

Figure 4:
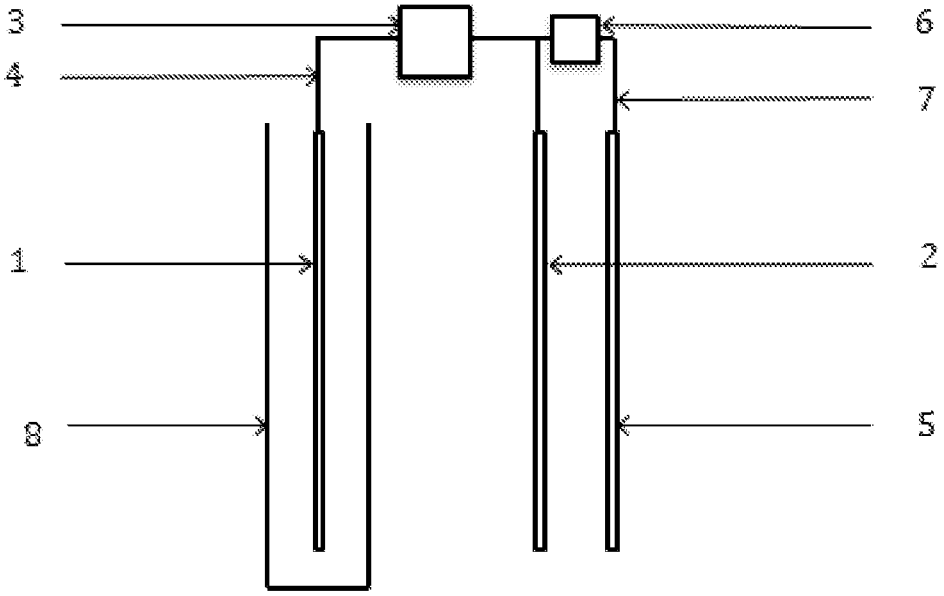
FIG. 4 shows a fourth example of a reactor that is a combination of the second and third previous examples of the reactor.

The fourth reactor configuration is a combination of the second and third configurations. Said cell, illustrated in FIG. 4, has the same elements as the third configuration (a counter electrode (1), a working electrode (2), a source of electricity (3) and a connection(s) between these three elements (4), where the anodic and/or cathodic and/or medium and/or cell potentials can be controlled with a potentiometer and/or potentiostat), and a third electrode (5), optionally a reference electrode such as for example silver/silver chloride, connected to at least one of the electrodes by a connection(s) (7), and of an element (6) to measure the potential difference between the working electrode and the third electrode and/or between the counter electrode and the third electrode. Said element (6) is preferably a voltmeter or multimeter, and can have/be connected to/collaborate with feedback/response/monitoring/adjustment systems related with the control system for the anodic and/or cathodic and/or medium and/or cell and/or partial ionic and/or pulp and/or zeta potential(s) or a combination of these. In addition, as for the second configuration, it has separator/s (8), which again can be constituted by ion exchange membrane(s), for example anionic or cationic exchange, either generic with for ions/elements/specific compounds, fluid membrane(s), organic phase(s), dialysis membrane(s), grate(s), sheet(s) or perforated structure(s), ionic bridge(s), filter(s), sponge(s), (porous) separator(s) for batteries or of any type, or a combination of these. Said separators may be placed at a certain distance from the electrode(s), e.g. finite-gap configuration, or in direct contact with the electrode(s), e.g. zero-gap configuration, or as a combination of these.

Figure 5:
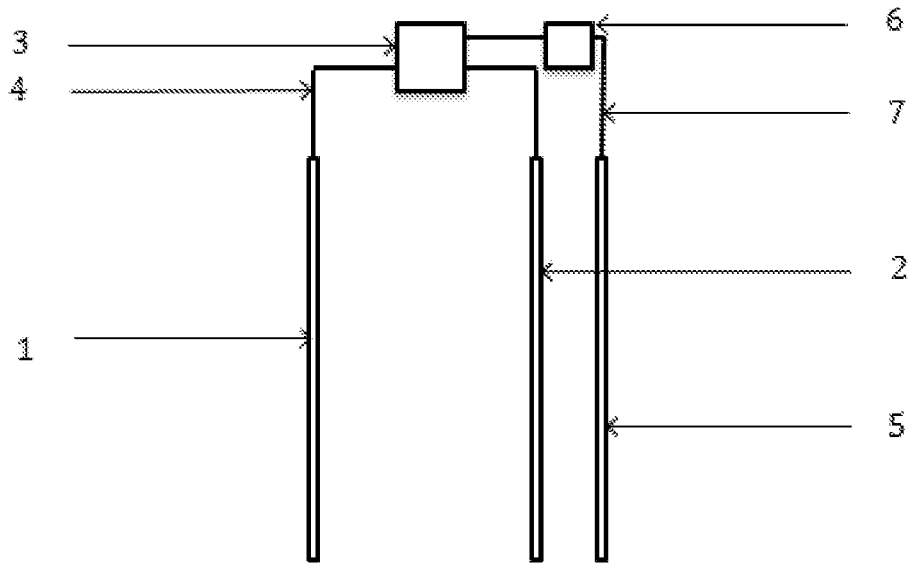
FIG. 5 shows a fifth example of a reactor that is a variation of the third example.

The fifth reactor configuration is a variation of the third configuration. Said cell, illustrated in FIG. 5, has the same elements as the third configuration. However, the configuration of said elements is different. As for the third configuration, the reactor has a counter electrode (1), a working electrode (2), a source of electricity (3) and a connection(s) between these three elements (4), where the anodic and/or cathodic and/or medium and/or cell and/or partial ionic and/or pulp and/or zeta potentials or a combination of these and/or with any electric supply/circuit/electric component (battery, plug, rectifier, etc. that can be assisted by a potentiometer and/or potentiostat). In this case, the third electrode, typically a reference electrode (5), is connected to the electric source (3) either directly or at a distance, optionally by means of a connection(s) (7). The electric source can have or be connected/coupled to a potentiostat/potentiometer/rheostat or any monitoring/control/adjustment system, optionally to modify the cell potential as a function of and/or to control/adjust the anodic and/or cathodic and/or medium and/or cell and/or partial ionic and/or pulp and/or zeta potentials or a combination of these.

Figure 6:
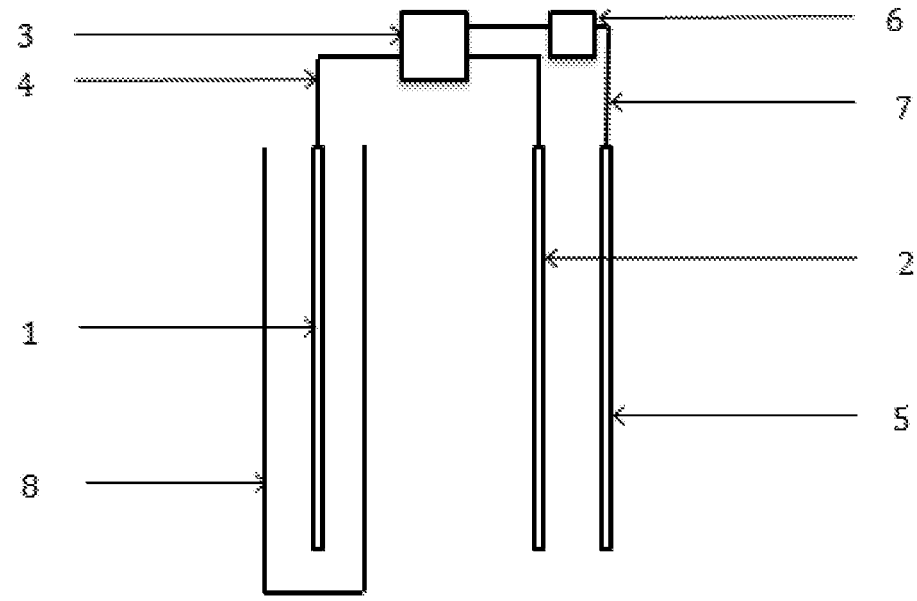
FIG. 6 shows a sixth example of a reactor that is a combination of the second and fifth examples.

The sixth reactor configuration is a combination of the second and fifth configurations. Said cell, illustrated in FIG. 6, has the same elements as the fifth configuration (a counter electrode (1), a working electrode (3), an electric source (3), a connection/s between these three elements (4), where the anodic and/or cathodic and/or medium and/or cell potentials can be controlled with a potentiometer and/or potentiostat, and/or with any electric source/circuit/electric component (battery, plug, rectifier, etc. that can be assisted by a potentiometer and/or potentiostat), and a third electrode (5), optionally a reference electrode such as for example silver/silver chloride, connected to the electric source (3) either directly or at a distance, optionally by means of a connection(s) (7). The electric source can have or be connected/coupled to a potentiostat/potentiometer/rheostat or any monitoring/control/adjustment system, optionally to modify the cell potential as a function of and/or to control/adjust the anodic and/or cathodic and/or medium and/or cell and/or partial ionic and/or pulp and/or zeta potentials or a combination of these). In addition, as for the second configuration, it has separator(s) (8), which again can be constituted by ion exchange membrane(s), for example anionic or cationic exchange membrane(s), either generic or with ions/elements/specific compounds, fluid membrane(s), organic phase(s), dialysis membrane(s), grate(s), sheet(s) or perforated structure(s), ionic bridge(s), filter(s), sponge(s), (porous) separator(s) for batteries or of any type, or a combination of these. Said separators may be placed at a certain distance from the electrode(s), e.g. finite-gap configuration, or in direct contact with the electrode(s), e.g. zero-gap configuration, or as a combination of these.

The reactor of any configuration uses at least one anode and at least one cathode, and is electro-assisted by applying and/or controlling a source of electric energy, to control and/or measure and/or modulate one or more of (i) cell potential(s), (ii) partial and/or relative and/or half-cell anodic potential(s), (iii) partial and/or relative and/or half-cell cathodic potential(s), (iv) medium potential(s), (v) partial potential(s) of species in solution, (vii) pulp potential(s) and (viii) zeta or mineral particle surface potential(s).

Figure 7:
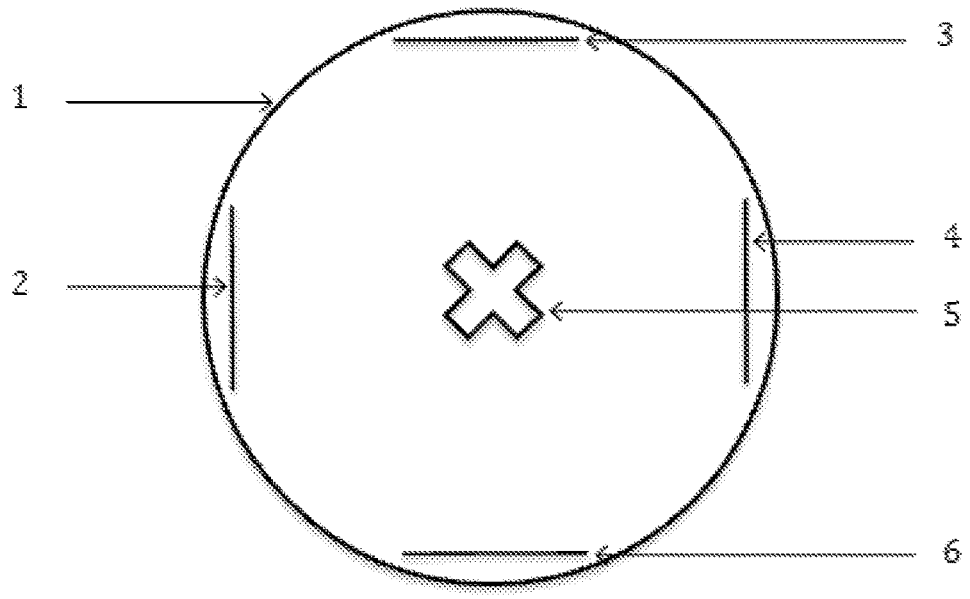
FIG. 7 shows an example of an arrangement of the reactors inside a tank (e.g. conditioning tank).

A simple example of use, as illustrated in FIG. 7, consists of the introduction of several electrochemical reactors in a tank (1) with stirrer (5). The reactors (2,3,4 and 6) could be arranged next to the tank wall, thereby (directly or indirectly) applying the potential to the mineral particles in a conditioning stage, for example prior to or intercalated in the rougher flotation or other flotations, for example the selective, cleaner, scavenger, spent, etc. flotations. Any possible cell shape and configuration could be used, as well as any arrangement of the different reactors, without necessarily placing these parallel to the tank walls.

For example, the process could be used in the conditioning tank prior to the rougher flotation. In this tank, it would be normal for around 800 to 1,200 tons of mineral to enter every hour, at 20-40% by weight/volume in water. If it is copper ore, the input mineral would typically contain between 0.4 and 2% copper, between 2 and 30% sulphur, between 1 and 20% iron, between 0.1 and 5% zinc as well as gangue (typically silicates) and other elements in lower quantities.

Figure 8:
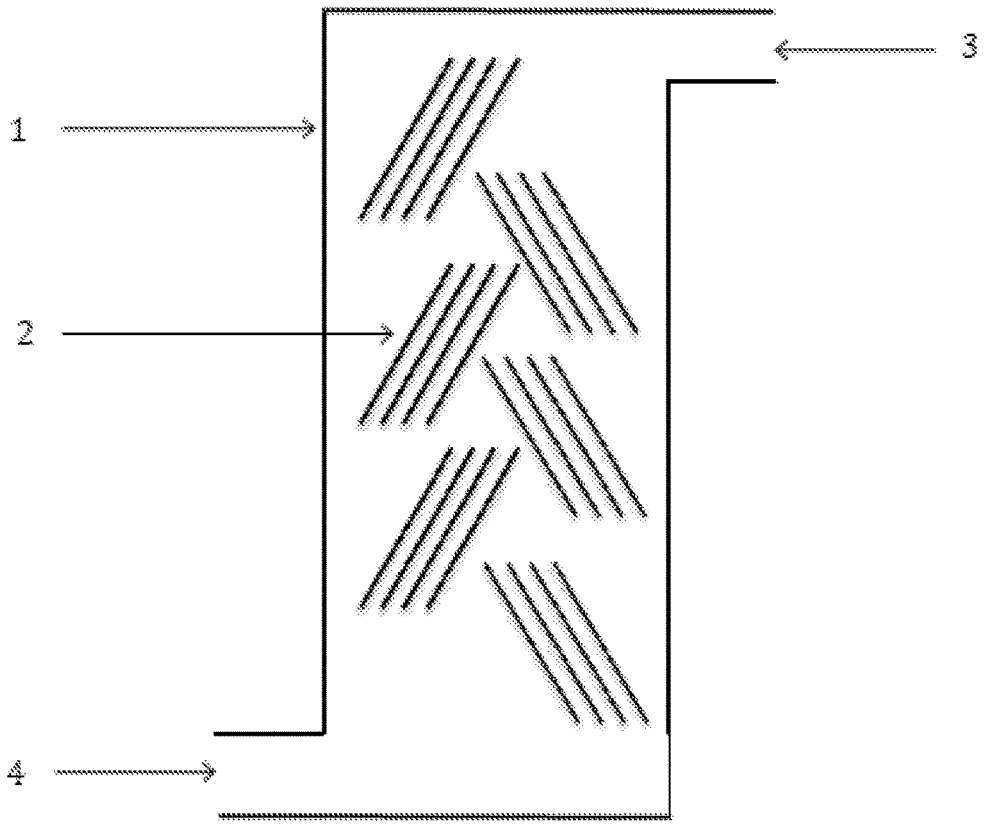
FIG. 8 shows an example of an arrangement of the reactors inside a passage (e.g. column reactor).

The input mineral into the tank typically has a D80 between 100 and 250 μm. It is stirred for about 2 to 5 minutes in this tank, before flowing into the rougher flotation. After the application of potential in said conditioning stage, for example between 1 and 12 V between the anode and the cathode, the copper grade of the concentrate could be increased several points (e.g. from 20% to 24% copper without and with the reactor, respectively), as well as increasing the recovery of copper in several points (e.g. from 86% to 88% without and with the reactor, respectively). A lower pH could also be used in the rougher flotation, maintaining the same grade (for example 20%) but increasing the recovery (e.g. an increase between 4 and 6%). Usually, this would not be possible without using the reactor, given that upon lowering the pH, the copper grade in the concentrate would decrease. On the one hand, the use of a lower pH in the rougher flotation (e.g. pH 10 instead of pH 11.5) would allow for important savings in lime (typically several tons of lime per day), while at the same time obtaining greater benefit from the same input ore or mineral that is introduced into the plant and that is to be treated (typically with 1% copper, which is concentrated up to 20%), given that less copper would be discarded. On the other hand, if we used this process to increase the copper grade in the concentrate, the use of depressors such as sodium metabisulphite (e.g. 400 g/tons of reground mineral) could be reduced or even completely eliminated. Another example of use, illustrated in FIG. 8, consists of the introduction of pulp into a passage, for example a column reactor (1), which contains one or more electrochemical cells (2) that can take any form. The pulp would be introduced through at least one entry (3) and would exit through at least one exit (4). The electrodes could take any shape, making use, for example, of large specific surfaces.

REFERENCES

[1] I. N. Plaksin and G. A. Miasnrkova; "Some Data on Depression of Pyrite by Lime"; Academy of Sciience SSSR, No. 4 (1956)

[2] K. Milena; "Depression of pyrite mineral with cyanide and ferrous/ferric salts"; Underground Mining Engineering 19 (2011) 149-155

[3] S. R. Grano, N. W. Johnson, J. Ralston; "Control of the solution interaction of metabisulphite and ethyl xanthate in the flotation of the Hilton ore of Mount Isa Mines Limited, Australia"; Minerals Engineering, 10, No. 1, 17-45 (1997a).

[4] S. R. Grano, C. A. Prestidge, J. Ralston; "Solution interaction of ethyl xanthate and sulphite and its effect on galena flotation and xanthate adsorption"; International Journal of Mineral Processing, 52, 161-186 (1997b).

[5] T. N. Khmeleva, D. A. Beattie, T. V. Georgiev, W. M. Skinner; "Surface study of the effect of sulphite ions on copper-activated pyrite pre-treated with xanthate"; Minerals Engineering, 16, 601-608 (2003)

[6] T. N. Khmeleva, W. M. Skinner, D. A. Beattie; "Depression mechanisms of sodium bisulphite in the xanthate-collectorless flotation of copper activated sphalerite"; International Journal of Mineral Processing, 76, 43-53 (2005)

[7] T. N. Khmeleva, J. K. Chapelet, W. M. Skinner, D. A. Beattie; "Depression mechanisms of sodium bisulphite in the xanthate-induced flotation of copper activated sphalerite"; International Journal of Mineral Processing, 79, 61-75 (2006)

[8] A. Guanghua, Y. Zhou, Y. Wang; "A Study on the Combined Depressant for the Cu—S Separation in Low Alkaline Medium and its Depressing Mechanism"; Procedia Engineering, Volume 102, Pages 338-345 (2015)

[9] B. Ball, R. S. Rickhard, edited by M. C. Fuerstenau; "A. M. Gaudin Memorial Volume"; American Institute of Mining Metallurgical and Petroleum Engineers, New York, 458 (1976).

[10] M. C. Fuerstenau, G. J. Jameson, R. Yoon; "Froth Flotation: A Century of Innovation"; SME (2007)

[11] S. Ramachandra Rao; "Surface Chemistry of Froth Flotation: Volume 1: Fundamentals"; Springer Science & Business Media, Jun. 29, 2013

The invention claimed is:

1. A process for the depression of sulphides in the flotation of mineral particles in liquid, comprising electrochemically depressing at least one sulphide through application of at least one electric potential applied to the at least one sulphide so as to electrochemically alter the at least one sulphide; and wherein the at least one electric potential is lower than an electric potential required for electrolysis of water.

2. The process, according to claim 1, wherein the at least one sulphide is electrochemically depressed through direct action of at least one electrode, with at least partial direct contact between the at least one electrode and the mineral particles in the liquid.

3. The process, according to claim 1, wherein the at least one sulphide is electrochemically depressed through indirect action of at least one electrode, wherein at least one potential of the at least one electrode is transferred to the mineral particles in the liquid by at least one mediator.

4. The process, according to claim 1, wherein the at least one electric potential is modulated without altering the pH of the liquid.

5. The process, according to claim 1, wherein the at least one electric potential is modulated to alter the pH solely at a localised level and not at a macro/general level.

6. The process, according to claim 1, wherein pH of the liquid is altered at a macro/general level.

7. The process, according to claim 1, wherein a cathode electrodeposits and/or precipitates and/or eliminates metals or other compounds from the solution.

8. The process, according to claim 1, wherein other mineral species are floated or depressed in a differential manner through the use of chemical reagents and/or electrodes, simultaneously, in parallel, in series, sequentially and/or in different treatment lines.

9. The process, according to claim 1, wherein the mineral is subjected to a pre-treatment or additional treatment, comprising bio treatments, passivation or oxidation by aeration of the mineral.

10. The process, according to claim 1, wherein the liquid is fresh water, mains water, recirculated process water, cleaned/treated process water and/or distilled water or water that is treated in any way.

11. The process, according to claim 1, wherein the process is galvanic or electrolytic.

12. The process, according to claim 3, wherein the at least one mediator is dissolved in the liquid.

13. The process, according to claim 1, wherein the at least one sulphide is iron sulphide.

14. The process, according to claim 1, comprising the steps of extraction, crushing, grinding and suspension of the mineral particles in the liquid before electrochemically depressing the at least one sulphide.

15. The process, according to claim 1, wherein other mineral species are floated or depressed through the use of chemical reagents and/or electrodes, simultaneously, in parallel, in series, sequentially and/or in different treatment lines to obtain different concentrates of metals.

16. The process, according to claim 1, wherein the process, according to claim 1, wherein other mineral species are floated or depressed in a differential manner through the use of chemical reagents and/or electrodes, simultaneously, in parallel, in series, sequentially and/or in different treatment lines to obtain different concentrates of copper and zinc.

* * * * *